United States Patent [19]

James

[11] 4,240,412

[45] Dec. 23, 1980

[54] MEDICAL DEVICE

[76] Inventor: Eugene James, 5413 Via Carrizo, Laguna Hills, Calif. 92653

[21] Appl. No.: 70,750

[22] Filed: Aug. 29, 1979

[51] Int. Cl.[3] ..... A61H 7/00

[52] U.S. Cl. ..... 128/67; 128/341

[58] Field of Search ..... 128/25 R, 79, 341, 303.11, 128/401, 359, 360, 255, 69, 67

[56] References Cited

U.S. PATENT DOCUMENTS

| | | | |
|---|---|---|---|
| 547,076 | 10/1895 | Hubbell | 128/24.1 |
| 745,920 | 12/1903 | Spencer | 128/360 |
| 1,749,632 | 3/1930 | Ferris | 128/359 |

FOREIGN PATENT DOCUMENTS

| | | | |
|---|---|---|---|
| 1499738 | 9/1967 | France | 128/360 |
| 233903 | 5/1925 | United Kingdom | 128/341 |

*Primary Examiner*—Lawrence W. Trapp
*Attorney, Agent, or Firm*—Gordon L. Peterson

[57] ABSTRACT

A medical device comprising first and second ball sections, an intermediate section having a peripheral surface and opposite ends, and first and second generally cylindrical sections for coupling the first and second ball sections to the opposite ends of the intermediate section. The first and second generally cylindrical sections project from the intermediate section in generally opposite directions. Each of the first and second generally cylindrical sections has a smooth cylindrical surface, and the diameter of the first ball section is greater than the diameter of the second ball section. The diameter of each of the first and second ball sections is greater than the diameter of each of the first and second cylindrical sections.

3 Claims, 2 Drawing Figures

MEDICAL DEVICE

BACKGROUND OF THE INVENTION

It is sometimes necessary for the treatment of various injuries or disorders to exercise and/or strengthen the muscles within or associated with various body cavities. For this purpose, it is known to utilize instruments of various different configurations for insertion into the selected body cavity for exercise and/or strengthening of the associated muscles.

For example, Hoard U.S. Pat. No. 1,928,839, Waters U.S. Pat. No. 2,763,265 and Martin U.S. Pat. No. 4,106,489 each show a device for insertion into the rectum or vagina for exercise and/or strengthening of the associated muscles. In addition, the following U.S. patents show other instruments of various different configurations for insertion into various body cavities for various different medical and/or surgical purposes:

Landis, U.S. Pat. No. 1,278,944
Bell, U.S. Pat. No. 2,653,599
Reimanns, U.S. Pat. No. 812,679
Stephan, U.S. Pat. No. 1,327,786
Wagoner, U.S. Pat. No. 1,042,642
Wagoner, U.S. Pat. No. 1,149,971
Lord, U.S. Pat. No. 3,675,642
Tallent, U.S. Pat. No. 3,894,,539

SUMMARY OF THE INVENTION

I have discovered a medical device of a particular configuration which is highly useful in developing or strengthening the muscles of the rectum. In particular, the invention is most useful in curing or assisting in curing or improving incontinence. Specifically, the medical device of this invention can be used to strengthen the muscles necessary to control elimination from the human body.

The medical device of this invention is adapted for insertion into the rectum so that the patient can bear down against it. This provides for an isometric exercise which has been found useful in curing or improving incontinence. This isometric exercise develops the muscles which control evacuation from both the intestines and bladder.

To accomplish this, the medical device includes first and second relatively hard ball sections having smooth peripheral surfaces, an intermediate section having a peripheral surface and opposite ends, and first and second cylindrical sections for joining the first and second ball sections to the opposite ends, respectively, of the intermediate section. Each of the ball sections is for insertion into the rectum, and because they are relatively hard, they are adapted for an isometric type of exercise. The use of two ball sections provides two important advantages. First, with the first ball section being utilized, the second ball section forms, or assists in forming, a handle for the medical device and, conversely, with the second ball section being utilized, the first ball section forms a handle. Secondly, by making the two ball sections of different diameters, the device is adapted for use with different sized body cavities.

To facilitate the use of one of the ball sections as a handle, the first and second generally cylindrical sections project away from the intermediate section in generally opposite directions. Each of the first and second generally cylindrical sections has a smooth, cylindrical peripheral surface for comfort of the user.

The diameters of each of the first and second ball sections should be greater than the diameters of each of the first and second cylindrical sections. Each of the opposite ends of the cylindrical sections project generally radially outwardly of the associated cylindrical section to define a shoulder extending radially outwardly of the associated cylindrical section. The shoulder forms a positive stop to limit insertion of the medical device.

In a preferred construction, the cylindrical sections are coaxial, and the axes of the cylindrical sections are coaxial with the ball sections. The medical device is advantageously integrally constructed from a hard plastic material. All of the exterior surfaces of the medical device are preferably smooth, and the opposite ends of the intermediate section are preferably generally flat, radially extending circular surfaces.

The invention, together with further features and advantages thereof, may best be understood by reference to the following description taken in connection with the accompanying illustrative drawing.

DESCRIPTION OF THE PREFERRED EMBODIMENT

Figure 1:
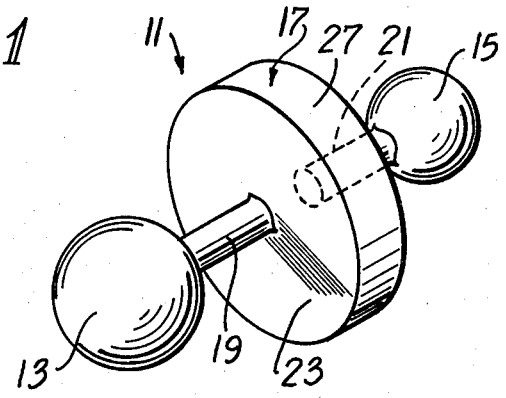
FIG. 1 is an isometric view of a medical device constructed in accordance with the teachings of this invention.

The drawing shows a medical device 11 which generally comprises a first ball section 13, a second ball section 15, an intermediate section 17, a first cylindrical section 19 and a second cylindrical section 21. The medical device 11 is integrally molded from plastic material, and all of the external surfaces thereof are smooth and hard so that the medical device is essentially noncompressible. The ball section 13 has a diameter larger than the ball section 15. For example, the ball section 13 preferably has a diameter of one inch, and the ball section 15 preferably has a diameter of $\frac{3}{4}$ inch.

Each of the cylindrical sections has a smooth, cylindrical outer surface. In the preferred embodiment, the cylindrical sections 19 and 21 are coaxial, and the axis of each of these cylindrical sections projects radially of the ball sections 13 and 15. The cylindrical sections 19 and 21 project in opposite directions from the intermediate section 17 and are integrally coupled to their associated ball sections 13 and 15.

The intermediate section 17 can be of various different configurations. However, in the embodiment illustrated, the intermediate section 17 has opposite ends or faces 23 and 25 and a peripheral surface 27. In the form of the invention shown in the drawings, the peripheral surface 27 is cylindrical, and each of the end faces 23 and 25 is circular and lies in a radial plane perpendicular to the axis of the medical device. The cylindrical sections 19 and 21 are integrally joined to the ends 23 and 25, respectively, of the intermediate section 17.

The axial dimension of the intermediate section may vary. However, in the embodiment illustrated, the axial dimension of the intermediate section is only $\frac{3}{8}$ inch. The diameter of the peripheral surface 27 should be greater than the diameters of the cylindrical sections 19 and 21, and in the embodiment illustrated, is $1\frac{1}{2}$ inches compared with $\frac{1}{4}$ inch for the diameter of the cylindrical sections. The axial dimension of each of the cylindrical sections is preferably only ½ inch. This assures that each of the ball sections 13 and 15 will be inserted only the correct amount, and neither of them can be inserted beyond the amount considered desirable for maximum benefit.

Figure 2:
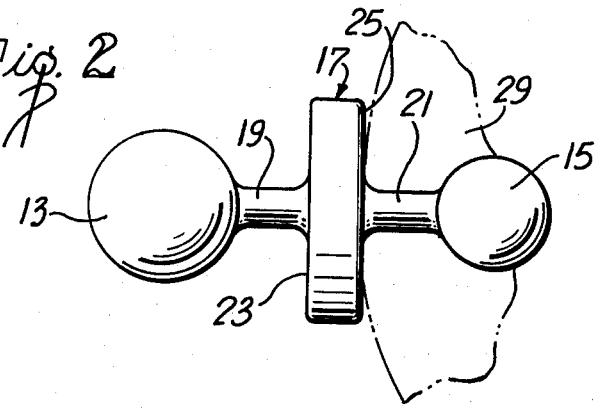
FIG. 2 is an elevational view of the medical device in use.

In use, either of the ball sections 13 or 15 may be selected for insertion. If the ball section 15 is selected for insertion, it can be, after proper lubrication, inserted into the rectum as far as permitted by the end face 23 using the cylindrical section 19 and the ball section 13 as a handle. Thereafter, the patient can constrict the muscles 29 (FIG. 2) of the rectum about the ball section 13 to provide these muscles with an isometric type of exercise. It has also been found that such exercise with the medical device 11 improves and strengthens the muscles controlling discharge from the bladder.

Although an exemplary embodiment of the invention has been shown and described, many changes, modifications and substitutions may be made by one having ordinary skill in the art without necessarily departing from the spirit and scope of this invention.

I claim:

1. A medical device comprising:

a first relatively hard ball section, said first ball section having a smooth peripheral surface;

a second relatively hard ball section, said second ball section having a smooth peripheral surface;

an intermediate section having a peripheral surface and opposite ends;

first and second generally cylindrical sections for coupling the first and second ball sections to the opposite ends of the intermediate section;

said first and second generally cylindrical sections being of about the same length and projecting from the intermediate section in generally opposite directions;

each of said first and second generally cylindrical sections having a smooth cylindrical surface;

the diameter of the first ball section being greater than the diameter of the second ball section;

the diameters of each of the first and second ball sections being greater than the diameter of each of the first and second cylindrical sections;

each of said opposite ends of said intermediate section projecting generally radially outwardly of the associated cylindrical section to define a shoulder extending radially outwardly of the associated cylindrical section;

said medical device being integrally constructed; and said cylindrical sections being coaxial with each other and with said ball sections.

2. A medical device as defined in claim 1 wherein the peripheral surface of the intermediate section is generally cylindrical and each of said opposite ends is a radial surface which is generally circular and flat, said medical device being constructed of a plastic material.

3. A medical device as defined in claim 2 wherein said first ball section has a diameter of about one inch, said second ball section has a diameter of about ¾ inch, and each of said cylindrical sections is about ½ inch long.

* * * * *